US009378614B2

(12) United States Patent
Wisler et al.

(10) Patent No.: US 9,378,614 B2
(45) Date of Patent: Jun. 28, 2016

(54) GAMING MACHINES PLAYERS' COMMUNICATIONS

(71) Applicant: Masque Publishing, Inc., Lone Tree, CO (US)

(72) Inventors: James M. Wisler, Lone Tree, CO (US); Anthony G. Andersen, Aurora, CO (US)

(73) Assignee: Masque Publishing, Inc., Lonetree, CO (US)

( * ) Notice: Subject to any disclaimer, the term of this patent is extended or adjusted under 35 U.S.C. 154(b) by 160 days.

(21) Appl. No.: 13/911,684

(22) Filed: Jun. 6, 2013

(65) Prior Publication Data

US 2014/0024430 A1 Jan. 23, 2014

Related U.S. Application Data

(60) Provisional application No. 61/673,522, filed on Jul. 19, 2012.

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/323* (2013.01); *G07F 17/34* (2013.01)

(58) Field of Classification Search

CPC . A63F 13/12; A63F 2300/402; A63F 13/795; A63F 13/87; A63F 2300/572; A63F 17/323; A63F 17/34

USPC ..... 463/42

See application file for complete search history.

(56) References Cited

U.S. PATENT DOCUMENTS

| | | | | |
|---|---|---|---|---|
| 6,638,170 | B1 | 10/2003 | Crumby | |
| 7,427,236 | B2 | 9/2008 | Kaminkow et al. | |
| 7,585,223 | B2 | 9/2009 | Iddings et al. | |
| 7,653,250 | B2 | 1/2010 | Jeong et al. | |
| 7,692,682 | B2 | 4/2010 | Pun et al. | |
| 7,695,358 | B2 | 4/2010 | Walker et al. | |
| 7,727,070 | B2 | 6/2010 | Shelby et al. | |
| 7,798,901 | B2 | 9/2010 | Nguyen et al. | |
| 7,817,180 | B2 | 10/2010 | Jeong et al. | |
| 7,828,649 | B2 | 11/2010 | Cuddy et al. | |
| 7,864,209 | B2 | 1/2011 | Jeong et al. | |
| 7,949,117 | B2 | 5/2011 | Jeong et al. | |
| 7,972,213 | B2 | 7/2011 | Walker et al. | |
| 8,460,109 | B2 | 6/2013 | Bryson et al. | |
| 2004/0127284 | A1* | 7/2004 | Walker et al. | 463/30 |
| 2004/0162144 | A1* | 8/2004 | Loose et al. | 463/42 |
| 2006/0245379 | A1 | 11/2006 | Abuan et al. | |
| 2007/0149278 | A1 | 6/2007 | Walker et al. | |
| 2008/0015010 | A1* | 1/2008 | Bird | 463/20 |

(Continued)

*Primary Examiner* — Steve Rowland

(74) *Attorney, Agent, or Firm* — Sheridan Ross P.C.

(57) ABSTRACT

Communication networks are established involving gaming machines, preferably slot machines. Each gaming machine has a card reader for obtaining player identity-related information using player identification cards and also has a number of communication related devices including a video screen. In forming a network, identity-related information from two or more player identification cards are accessed using the card reader of one of the machines. A menu and a number of screens are displayable using the machine's video screen to facilitate the establishment of communication networks, as well as control elements being displayed for use in controlling communications using the communication-related devices.

20 Claims, 9 Drawing Sheets

(56) References Cited

U.S. PATENT DOCUMENTS

2008/0172463 A1 7/2008 Qin et al.
2009/0111576 A1* 4/2009 Ostergren et al. ..... 463/29
2011/0116409 A1 5/2011 Jeong et al.
2012/0122590 A1* 5/2012 Nguyen ..... 463/42
2012/0206557 A1 8/2012 Ridges et al.
2012/0209933 A1 8/2012 Ridges et al.
2012/0270660 A1 10/2012 Walker et al.

* cited by examiner

GAMING MACHINES PLAYERS' COMMUNICATIONS

CROSS REFERENCE TO RELATED APPLICATION

This application claims the benefits of, including priority to, U.S. Provisional Application Ser. No. 61/673,522, filed Jul. 19, 2012 entitled "Gaming Machines Players' Communications", the entire contents of which is incorporated herein by this reference.

FIELD OF THE INVENTION

The present invention relates to enabling communications between and among players of gaming machines, such as slot machines.

BACKGROUND OF THE INVENTION

Casino slot games are immensely popular among a large and ubiquitous universe of players. Such appeal results in substantial numbers of slot machines for play in casinos located throughout the world. Generally, slots players are excited when they hit a jackpot and they enjoy telling others about their luck or success right after it happens, sometimes even telling players they don't know or wouldn't normally talk to. Such communications add to the thrill of winning while playing slots. Slots players occasionally come to casinos in groups to play slots. These groups might include family, personal friends and/or "slots buddies." While playing, it can be fun for slots players to be able to communicate with each other about their play or any other topic of interest. However, it may be that the slot machines being used by such friends are not close enough together to allow for viable communications. Related to that, it can be difficult for slots players to see the expressions on the faces of their slots friends during play, which expressions can also add to the enjoyment of playing at the same time with friends.

It is well-known for gaming machines or devices to be networked or interconnected in casinos for one or more reasons. Such networking is described in a large number of U.S. patents and such include the following: U.S. Pat. Nos. 7,828,649; 7,798,901; 7,727,070; 7,695,358; 7,585,223; 7,427,236; and 6,638,170. Various networks for communication purposes that can be dynamically established have also been devised. Such networks may involve the use of a central or main controller or server through which all communications are routed between or among a number of clients or other user modules or machines. Alternatively, the networks being formed might utilize a peer-to-peer (p2p) technology or communications system platform, which basically circumvents the need for a centralized communications controller. The owner of this application has filed patent applications that include p2p communication systems, namely: U.S. patent application Ser. No. 13/028,698 filed Feb. 16, 2011 entitled "Peer-To-Peer Communications" and its CIP identified by U.S. patent application Ser. No. 13/372,645 filed Feb. 14, 2012 entitled "Communications Adaptable to Mobile Devices." The contents of each of these two patent applications are hereby incorporated by reference in their entireties into this application. Despite the disclosures and other advances made related to the networking of gaming machines, including slot machines, and those related to communication networks, a robust and straightforward capability of communicating among slots players involving slot machines would be of benefit to such players, as well as casino operators.

SUMMARY OF THE INVENTION

In accordance with the present invention, communications are enabled involving players of gaming machines, such as slot machines, using a number of slot machines in a casino that are joined together in a network. Each slot machine in the network is computer or processor controllable, as well as having the following devices for use in providing communications: a microphone, a speaker, a camera and a video screen. Each slot machine also has a card reader for reading player identification (id) cards, with each card having direct or indirect identity-related information associated with a particular player. Such hardware is conventional and well-known, as is the networking of the slot machines.

This conventional slot machines network including such hardware devices is modified or advantageously supplemented by one or more software programs or modules in order to provide or make available communications between or among determined players of a subset of the networked machines. Basically, the software is used in establishing a communications network that includes at least two machines and is used in enabling communications with players that are using these at least two machines of the conventional network of gaming machines.

With regard to establishing the communications network, the player id cards and the card readers of the machines that are to be included in such a network constitute an integral part of the communications network forming process, at least with respect to an initial communications network involving two or more particular players or users. Upon the two or more players deciding that they want to communicate with each other while playing slot machines, a card reader of one, or the first, machine is used to receive the id card of one, or the first, of the players. The card reader and associated software are used in accessing the identity-related information residing on the player's id card. Such information from the first player's id card can be prepared or used in connection with establishing a communications network that would involve the machine being used by the first player, which machine could be the first machine or a machine different than the first machine. After the first player's id card is inserted in the first machine's card reader, a main menu is displayed on the video screen of the first machine. In one embodiment, the main menu includes a "my friends" label and/or icon. When initially establishing a communications network with new players or friends, enabling or contacting this icon results in an "add friends" screen being displayed that preferably also includes the icons found in the main menu. The "add friends" screen is used along with one or more other players' id cards, which players want to communicate with each other while playing slots or another game, to add players to one or more friends' list identifying those players in a particular group that can communicate with each other.

More specifically, while the "add friends" screen is displayed, this particular network continues to be formed by removing the first player's id card and inserting another or second player's id card into the same card reader of the first machine. The identity-related information of the second player is accessed using this machine in the same way as that of the first player. The second player, based on his or her identity-related information, is added and saved to the friends' list of the first player. Correspondingly, the first player is included with the friends' list of the second player.

For additional players to be included in this particular communications network and while an "add friends" screen is displayed, their id cards are read or accessed like the first two players. Concomitantly, each of these additional players has their friends' list changed to include identity-related information of all the other players. Once all players who want to be part of this particular communications network have had their id cards scanned or accessed, the first player's id card can be re-inserted into the card reader when the first player wishes to play the game, such as slots, using the first machine. Such information provided by this first card acts as a fingerprint or signature indicative of this machine being used by the first player. Alternatively, the first player may decide to play the game with a machine other than the first machine. In such a case, another player (e.g. the second player) may want to use the first machine. Stated differently, it is not necessary that the same machine (e.g. first machine) that was used in accessing player identity-related information be used in subsequent play and/or communications.

Continuing with the formation of this particular communications network, using another or second machine, the second player inserts his id card into the second machine's card reader. With at least the first player's id card inserted in a card reader that is part of, for example, the first machine, this second card insertion results in a "join" screen being displayed on the video screen of the second machine. This join screen includes the name(s) from the previously created "friends' list" of each friend who has her (or his) card inserted in one of the networked machines. In the case in which at least the first player's id card is in the card reader of the first machine, the displayed list includes at least the first player's identity. The second player can become part of the communications network with at least the first player by enabling or contacting a "join" button or activation element displayed on the screen. Likewise, other players who are to be part of this particular communications network follow comparable steps using each of their respective machines. Each such player's respective machine will ultimately display a join screen that includes the main menu. The join screen includes the names from the friends' list of those other players who have their cards inserted into the card readers of their respective machines. Each such machine screen also has a join button that, upon activation, results in each such player becoming part of the communications network being established.

Additionally, for each player having a machine that is part of this formed network, the player's video screen can also display an image of each of those players. Each image can include a still photograph of the player, a live video of the player or no image (unavailable). For example and regarding the first machine being used by the first player, an image associated with the first player can be provided adjacent to the menu icons. The other players' associated images can be located to the left of the first player's image. Regarding the images of the second player and any other players, each of their associated images can also be located adjacent to the menu icons on the video screens of their respective machines, with the images of the remaining players of the formed network provided to the left of each of their associated images.

More buttons, contacts or other control elements related to providing verbal and video communications can also be shown on the video screen near, or associated with, such player images or indicia. With respect to verbal communications, the first player's video screen also displays controls and indicators for enabling or disabling the first player's verbal communications to each of the other players on the network. That is, at any particular time, the first player may want to be able to speak to, using the machine's microphone, one, more than one, or all of the other players involved in the network. Conversely, the first player may want to inhibit speaking to at least one of the other players. Likewise, the first player may want to control, using the machine's speaker(s), those players' verbal communications that will be heard by him. Similar controls and indicators, which are part of the first player's machine, can also be used to control one or more displays of player images including the first player's own image. All other players on the network have the same controls and indicators related to enabling or disabling video and verbal communications. More information and descriptions regarding such voice and video communications are found in the afore-identified patent applications that were incorporated by reference.

In addition to the "my friends" label and/or icon, a "settings" label and/or icon is part of the main menu. In the context of the first player using the first machine and when accessed, the settings screen can have or show one or more of the following: (a) at least some information obtained using the first player's id card, such as the player's name; (b) user supplied id information; (c) a still photo or picture of the first player; (d) a live video image including the first player; (e) an avatar, or silhouette, if no avatar image is provided; and (f) an indication of the first player being unavailable. The settings screen can also include a "permission requirement" button or selector, which the first player must turn off or "don't require" to permit any other person or player to include the first player in that other person's "friends' list." If this selector is in a "do require" position, the first player's permission must be obtained in order to include the first player in any one or more other player friends' lists. All other users in the communications network can have their own unique settings displayable on the video screens of their respective machines, comparable to that found with the machine being used by the first player.

A further capability associated with establishing communication experiences for players of gaming machines relates to use of an on screen keyboard to input the names or identities of players that join a particular communications network. An "enter" button or activation element is included with the "add friends" screen. Instead of using a player's id card, the enter button can be contacted or otherwise engaged, which results in a keyboard being displayed. The keyboard can be used to input identity-related information of a player who is joining the network, just like a player who joined using her id card. When a player joins a particular communications network using her card and the same card reader being used by the other players forming the network, the player is automatically included in the friends' list of each of the other players who are joining the same network using their cards. However, a player joining the network by keyboard input, and not using the same card reader as the input, is not necessarily automatically added to one or more of the friends' list(s) of one or more of the other player(s) forming the network.

Based on the foregoing, the present invention enables one or more communications networks to be established involving one or more subsets of networked gaming machines including slot machines. The ease and robustness associated with establishing such networks is marked by use of player id cards and machine card readers, including use of one machine's card reader to obtain identity-related information from each player who wants to be involved in a particular communications network. Indicators and controls related to visual and verbal communications can be provided with the video screens of the networked machines so that the users can be aware of and can select how they want to communicate with one or more other machines (including the players thereof) that are part of their network. A main menu and a number of screens are provided in connection with establishing and using a network in order to enhance and facilitate the player's communication experiences including related to joining a particular network and displaying identity-related information and/or player associated images.

Additional advantages of the present invention are readily apparent, particularly when taken together with following descriptions including the accompanying drawings.

DETAILED DESCRIPTION

Figure 1:
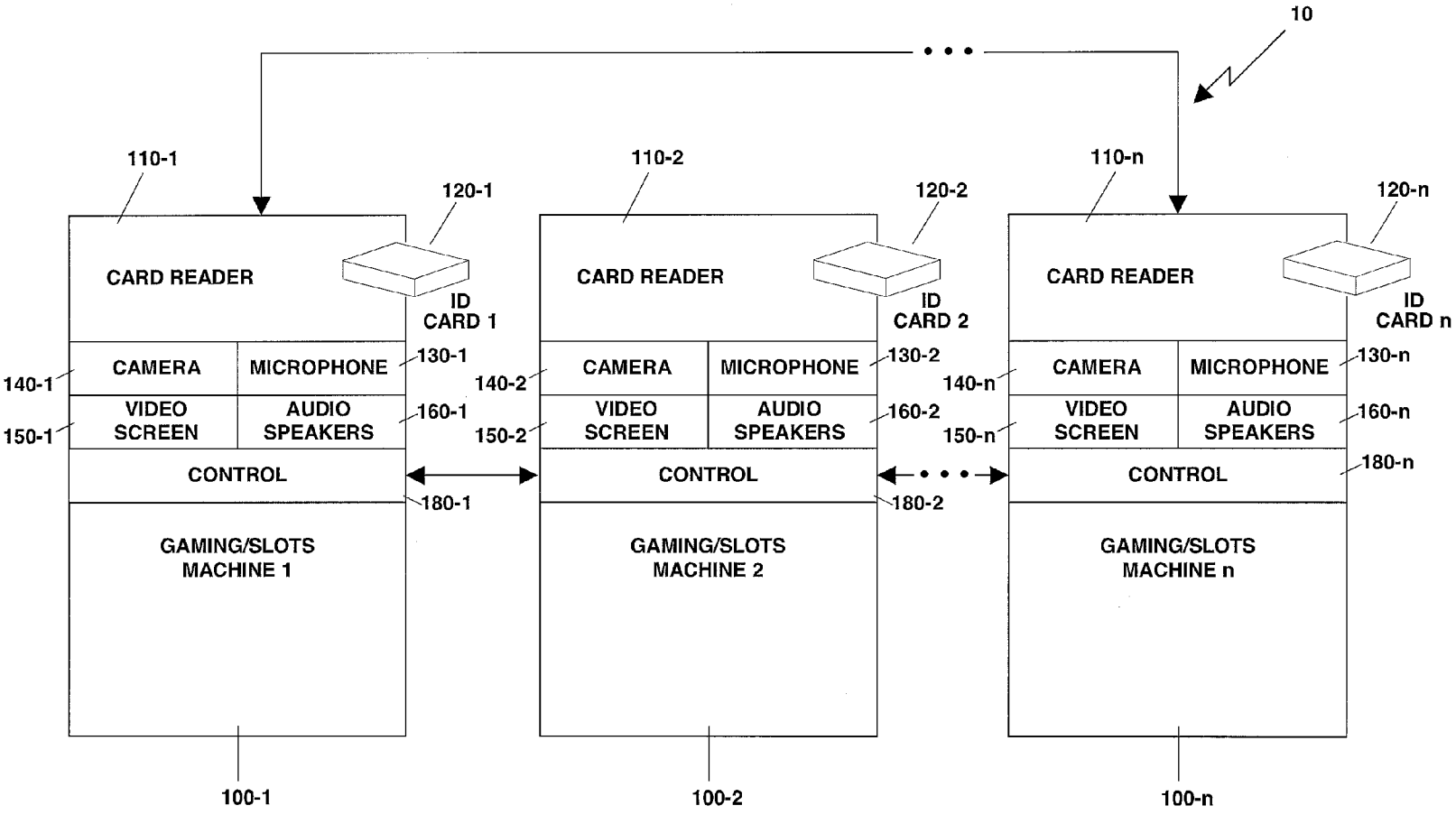
FIG. 1 is a block diagram that illustrates a number of networked gaming machines, such as slot machines, that can be a subset of a larger number of gaming machines available for play in a casino and in which these machines can receive identity-related information and include communication devices and software for providing a communications network.

With reference to FIG. 1, a system 10 for providing player communications is illustrated. The system includes a plurality of gaming machines 100 including gaming machines 100-1, 100-2 . . . **100-*n*. In the preferred embodiment, these machines 100 are conventional or known slot machines, which are connected together to form a network of machines 100 whereby each of them can directly communicate with one or more of the other machines 100. According to the embodiment of FIG. 1, each machine 100 is directly connected to each of the other machines 100** in the network. The network can be a subset of a larger number of gaming machines located in one or more casinos.

As conveyed by FIG. 1, each gaming machine 100 includes a card reader 110, namely card readers 110-1, 110-2, . . . **110-*n* being part of the gaming machines 100-1, 100-2, . . . 100-*n*, respectively. The card readers 110 are able to receive inserted cards, such as the identification (id) cards 120. Each of the depicted id cards 120-1, 120-2, . . . 120-*n* is a conventionally provided identification card that preferably has or contains identity-related information of one gaming machine player or user. Each card reader inserted id card 120** can be accessed or read to obtain the identity-related information of the gaming machine player for desired use including digital storage of such information. As will be described later, a particular players' communications network can be established by obtaining player/user identity-related information from each player's id card.

Each gaming machine 100 also has a number of communication related devices including: a microphone 130, a digital or web camera 140, a video screen 150, and one or more audio speakers 160. Referring to gaming machine 100-1, it has a microphone 130-1 for receiving voice and other sound-related inputs, which inputs are transmittable to other gaming machines 100 in the network of the system 10. The microphone 130-1 is useful in receiving voice inputs from the player using the gaming machine 100-1 who wants to talk with one or more other players using other machines 100 in the network. For example, the player playing slots using the gaming machine 100-1 has the ability to talk with other players playing slots using the other gaming machines 100 during play or during a break in play, including before play begins and after play ends. Since the other gaming machines 100-2 . . . **100-*n* also have microphones 130-2 . . . 130-*n***, the players using these machines also have the ability to use them in connection with talking to other players.

Continuing with the description of the representative gaming machine 100-1, it has a camera 140-1 for receiving video inputs, which can be transmitted to the other gaming machines 100 in the established communications network. The camera 140-1 is useful in receiving video information available within the range of the camera 140-1, such as the face or image of the player using the gaming machine 100-1, so that the person playing slots using gaming machine 100-1, for example, can provide his or her video inputs to other players using the networked gaming machines 100. Like being able to talk to other players using the microphones 130, players using the other gaming machines 100-2 . . . **100-*n* also have the ability to use their own cameras 140-2 . . . 140-*n*** in order to send their own images or other video information.

Another communication related device of the gaming machine 100-1 is the video screen 150-1, which is useful in displaying video that can be associated with video data provided by one or more of the gaming machines 100, including the gaming machine 100-1. The video data are the product of what is viewed by the cameras 140 of these gaming machines 100 including player images and other video outputs. Likewise, each of the other video screens 150-2 . . . **150-*n* is able to output resulting video obtained using the cameras 140** of this communications network. As provided in more detail in later descriptions, the video screen is useful and necessary in displaying programmed screens related to establishing communications networks involving players.

The remaining communication output device included with the gaming machine 100-1 includes one or more audio speakers 160-1 for outputting audio that results from inputs to the microphones 130-2 . . . **130-*n*, including outputting voice that was provided by one or more users of the gaming machines 100-2 . . . 100-*n*. Preferably, audio received by the microphone 130-1 is not output by the audio speaker(s) 160-1. The other audio speakers 160-2 . . . 160-*n* of the network of gaming machines 100-1 . . . 100-*n* function similar to the audio speaker(s) 160-1 with respect to being able to output audio received by the microphones 160, except not outputting audio resulting from the microphones 130 associated with their own gaming machines 100**.

Figure 2A:
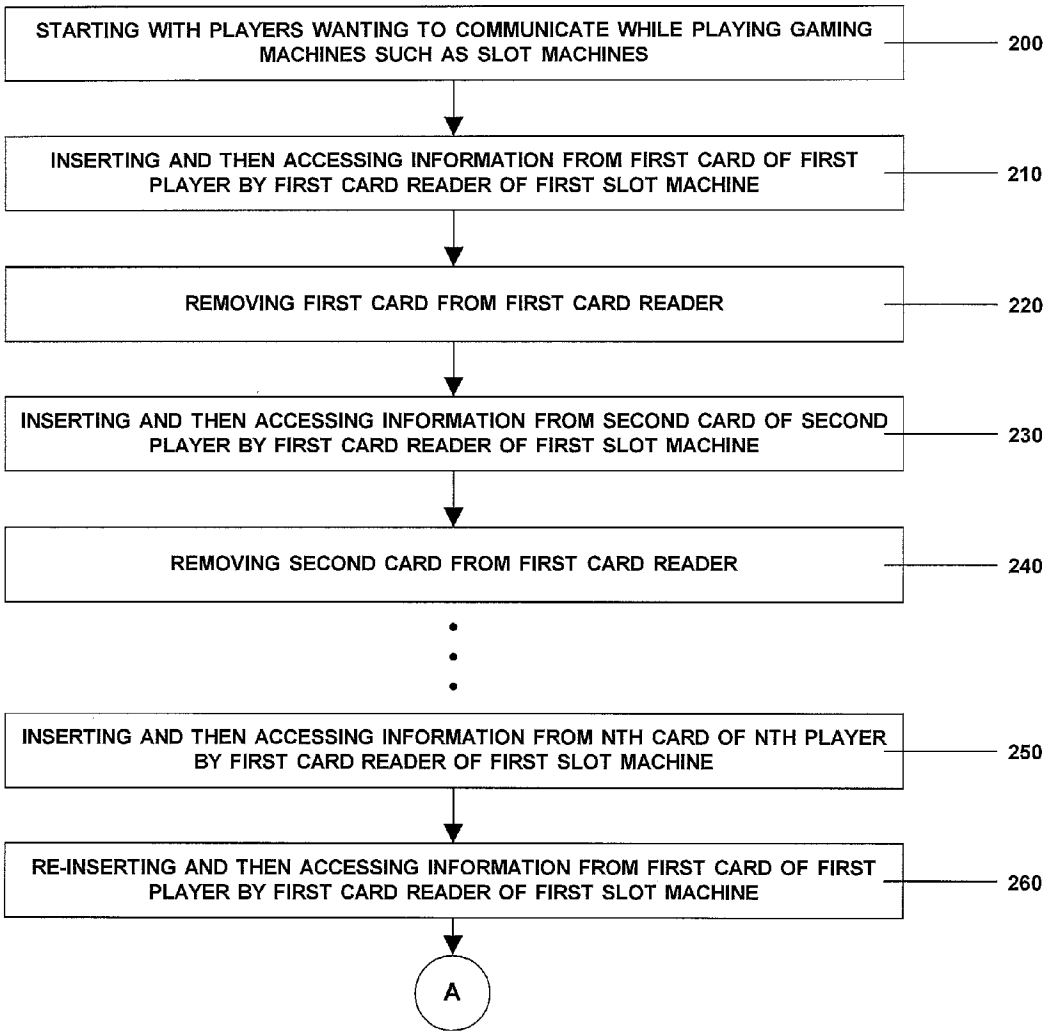
FIGS. 2A-2B are flow diagrams of one embodiment that illustrates basic steps or stages related to at least initially establishing a communications network involving the networked gaming machines.

In addition to such information obtaining and communicating-related hardware, each gaming machine 100 has a control 180 so that the gaming machines 100-1 . . . **100-*n* also include the controls 180-1, 180-2 . . . 180-*n*, respectively. Each control 180 has one or more processors for use, among other things, in establishing the communications network that can involve all gaming machines 100, or at least some of them. Such communications network can utilize the just described communication devices in providing visual and verbal communications involving the users of these gaming machines. Each control 180 is able to execute novel software used in establishing the communications network involving such gaming machines 100. A number of basic steps or process stages are implemented, especially related to initially establishing a communications network involving two or more particular users or players of the gaming machines 100. The following description, related to initial establishment of a particular network, refers to the first time (all players have not previously established a network) such a network is formed that involves certain players. With reference to FIGS. 2A-2**B, these steps or stages are next discussed.

Block 200 of FIG. 2A indicates that establishing the network of gaming machines 100 starts with two or more players of the gaming machines 100 wanting to communicate with each other. This plan to communicate can be the result of the players wanting to play slot machines while talking to and seeing each other during play, with such players being friends, family and/or some other group of slots players. Each player or user has an id card 120 that contains information and/or data that uniquely identifies that particular player. The use of such id cards is important in establishing a communications network between or among the players, particularly the first time such a network is established involving these players. A description is now provided of a representative example for establishing a network using the machines (e.g. slot machines) 100. As denoted by block 210, the first id card 120-1 of the first player is inserted, according to this representative example, into the first card reader 110-1 of the first slots machine 100-1. The control 180-1 is used in securing identity-related information of the first player that is found with the first id card 120-1 using the first card reader 110-1. The identity-related information may include any, but sufficient, information to distinguish the first player from all other players, who might want to communicate using at least some slot machines 100 during a period of time. The read or obtained information can be stored for later use and/or processed as part of establishing the communications network.

Figure 3A:
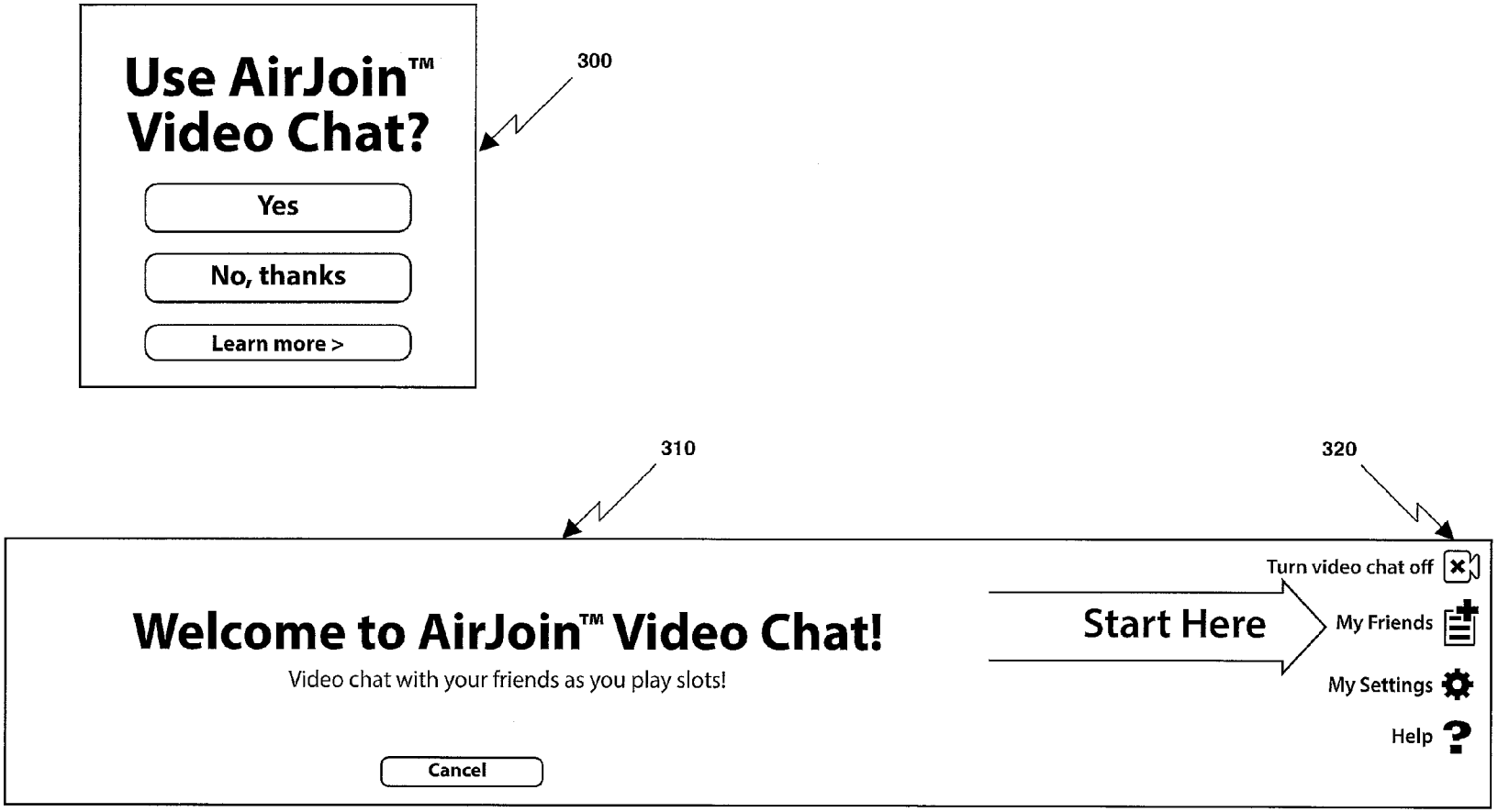
FIGS. 3A-3E illustrate screen displays including a main menu for use in establishing one or more communication networks involving gaming machines.

With reference to FIGS. 3A-3E, a number of screen shots or displays associated with the formation of a particular network are illustrated. When the first id card 120-1 is inserted and read using the card reader 110-1 and the control 180-1, screen 300 of FIG. 3A is caused to be displayed and includes a query related to whether or not the first player wants to use the novel communications network software (described in the afore-noted applications), which is identified using the trademark "AirJoin." Upon enabling the button or selector that indicates that the player wants to establish or use a particular communications network, a "welcome" screen 310 is displayed. The "welcome" screen 310 comprises a main menu 320. In this illustrated embodiment, the main menu includes at least two icons and/or labels. A "my friends" icon and label is used to provide a link to another screen for use in adding friends. As part of the current description relating to a network being formed for the first time by all players involved, the first player or user is prompted to click on or otherwise enable the "my friends" link. Selecting this link causes an "add friends with a first prompt" screen 330 of FIG. 3B to be displayed related to removal of the first card 120-1 and insertion of another id card.

Figure 3B:
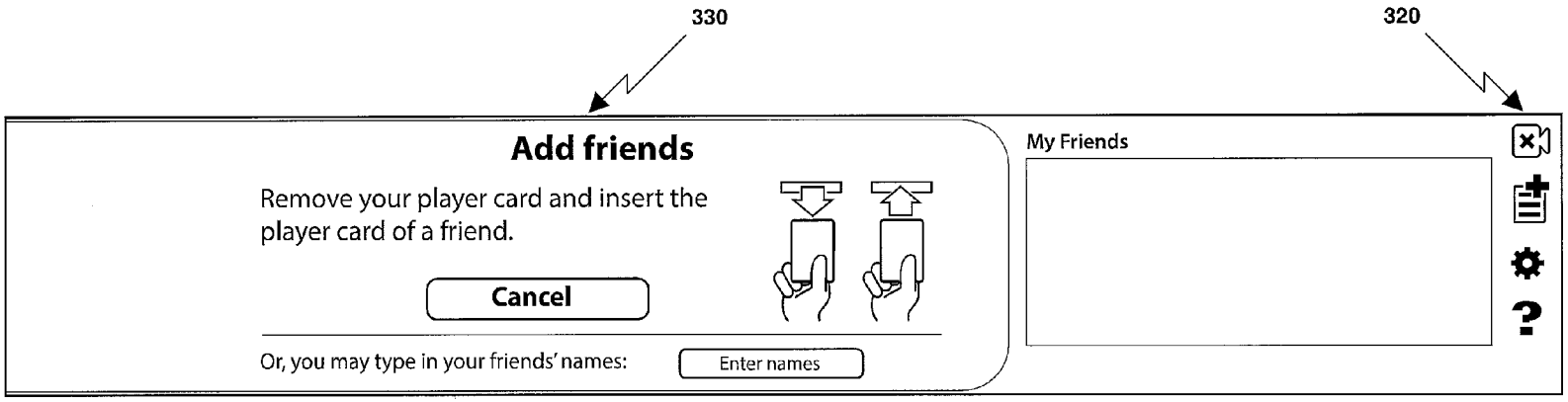
Figure 3B:
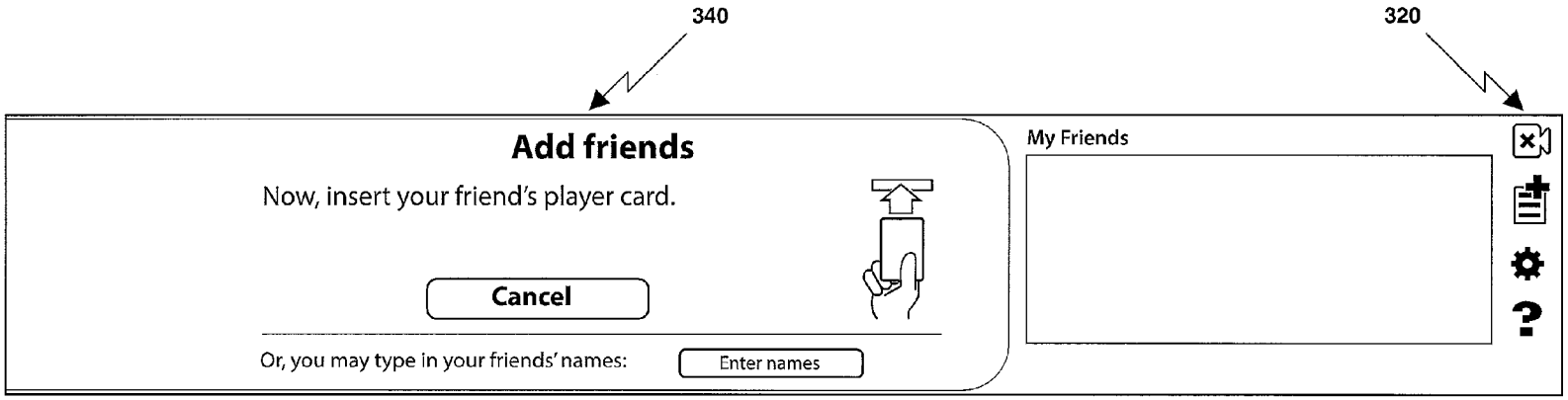

Returning to FIG. 2A, after an identity related to the first player has been read and stored for possible communications with other players in the network being formed, the first id card 120-1 is removed from the card reader 110-1, such as by the first player, in accordance with block 220. When the first player's card 120-1 is removed, an "add friends with a second prompt" screen 340, as illustrated in FIG. 3B, is displayed related to inserting another player's card. Acting on the prompt found with screen 340, another player's card, such as the second player's id card 120-2 is inserted into the card reader 110-1, as denoted by block 230 of FIG. 2A, in order to add the second player to the list of players for communication associated with this particular, initial network. Since the second player, in this example, is the initial player included with first player's friends' list, the second player is the first and only player at this time indicated as being part of the "my friends" list shown in the "friend added" screen 350 depicted in FIG. 3C. In continuing the network forming process, the second id card 120-2 is then removed from the card reader 110-1, as indicated by block 240 of FIG. 2A. This card removal is prompted by the "friend added" screen 350. For each and any further player(s) to be made part of this initial network, a similar process is conducted. That is, while continuing to refer to FIG. 3C, an "add more friends?" screen 360 is provided, for use by the one of the players, such as by the first player, to return to the "add friends with second prompt" screen 340 of FIG. 3B.

Figure 3C:
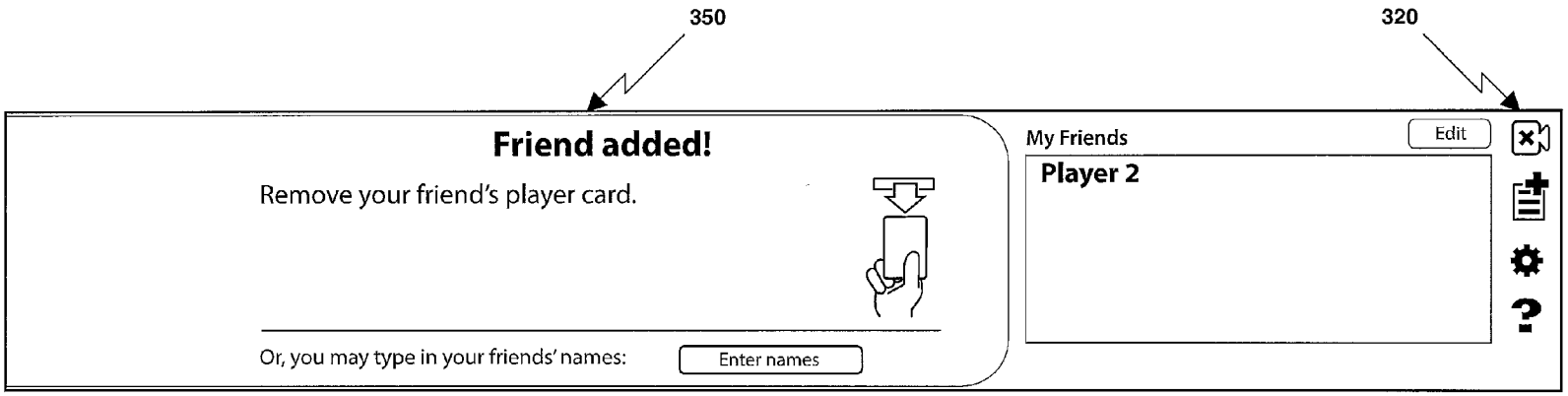
Figure 3C:
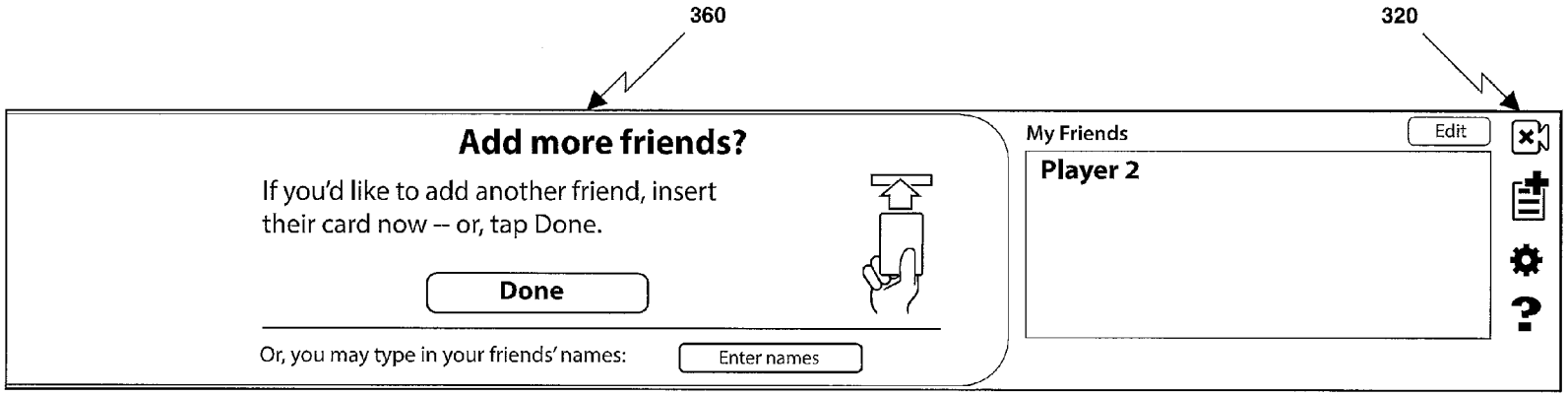
Figure 3D:
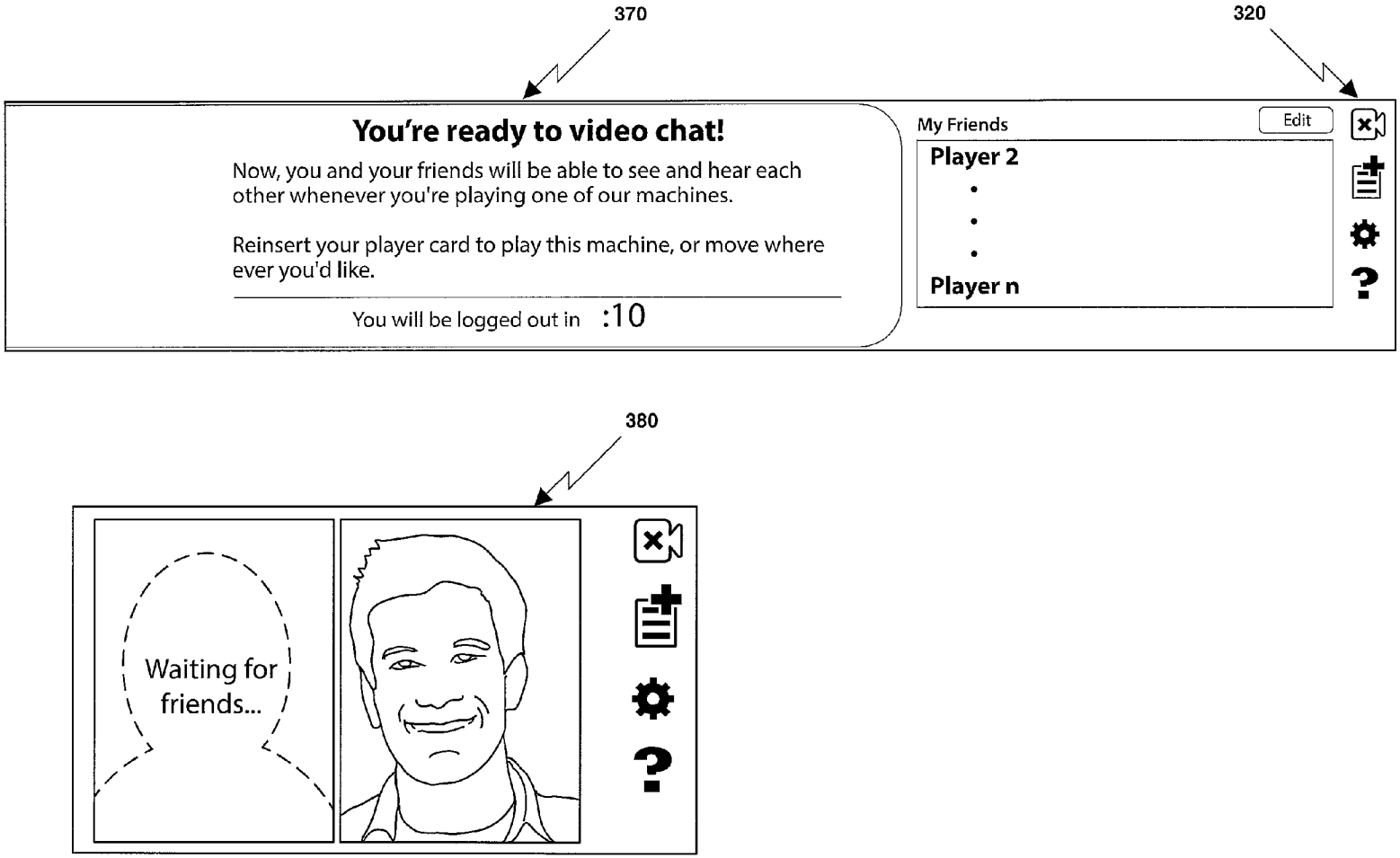

Like described above, a third player, or more players, could be included in the network being formed, including a last or nth player. Referring again to FIG. 2A, when an nth player is to be included, the id card **120-*n* is inserted into the card reader 110-1, as noted by block 250. Once the nth id card 120-*n* is removed from the first card reader 110-1, the "add more friends?" screen 360 of FIG. 3C is displayed. Since no more players are to be added to this network, one of the players, such as the first player, contacts or otherwise activates the "done" button or selector provided with this screen 360. The activation of the "done" button causes a "ready" screen 370 of FIG. 3D to be displayed indicating that the players included in the network can communicate with each other using the gaming, such as slot, machines 100 that they are or will be using. The screen 370 also shows a timer related to a predetermined time being provided before the machine 100-1 is logged out (at least for some time no longer part of the network being formed). That is, the first player has a predetermined amount of time (e.g. ten seconds) to re-insert her id card 120-1. If not re-inserted, then this machine 100-1 discontinues its association with the first player and other players could use this machine and not be part of this first network being formed. On the other hand, even if the predetermined time expired, if the first machine were still available for play, then the first player (or any other player) in the network being formed could use her card 120 so that the gaming machine 100-1 is part of this first communications network. The steps or stages associated with the process of establishing communications networks can have additional timers related to predetermined times within which one or more players must take actions regarding use of their cards 120 before a machine 100 stops being associated with a network being formed. Additionally, FIG. 3D (screen 370), as well as FIG. 3C (screens 350, 360), depicts an "edit" button or selector which can be engaged or otherwise used by the player in connection with deleting or removing one or more names from her/his "my friends" list. When a user's name is removed from one player's list, the one player is automatically removed or deleted from the list of that user whose name was removed from the one player's list. That is, there is a mutual deletion of these players from each other's lists, just as there is a mutual addition to these two players "my friends" lists when one of the players adds the other to the player's "my friends" list. Such mutual deletion means that neither of the two players has the benefits associated with being part of the others "my friends" list, including being made aware of the other player being available for communications, as will be discussed later related to FIG. 3**E and the possibility of joining a group. It should also be understood that any player whose name is removed from a "my friends" list could once again be included in that list by using the steps already described related to adding a player or user to a "my friends" list, which would also result in an automatic mutual addition.

Figure 2B:
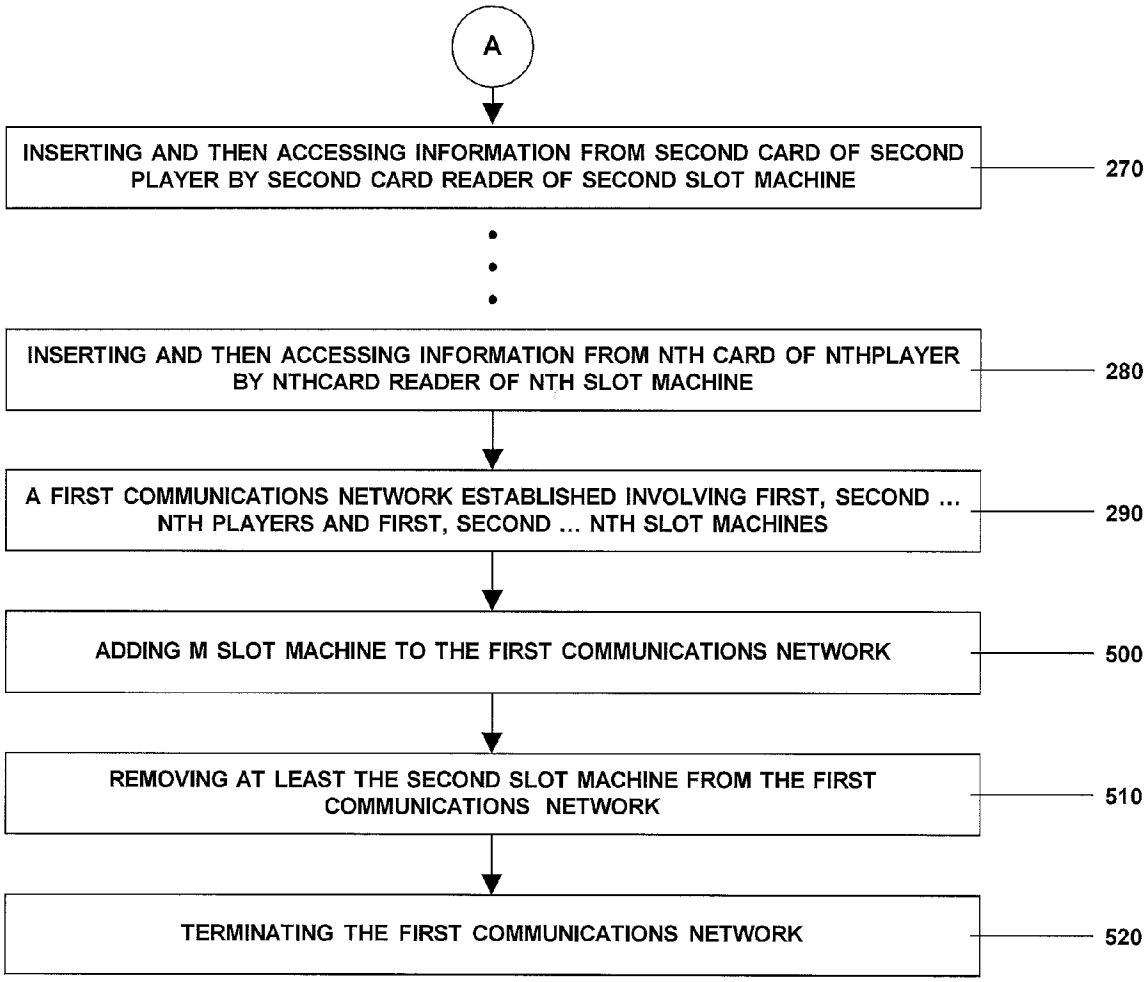
Figure 3E:
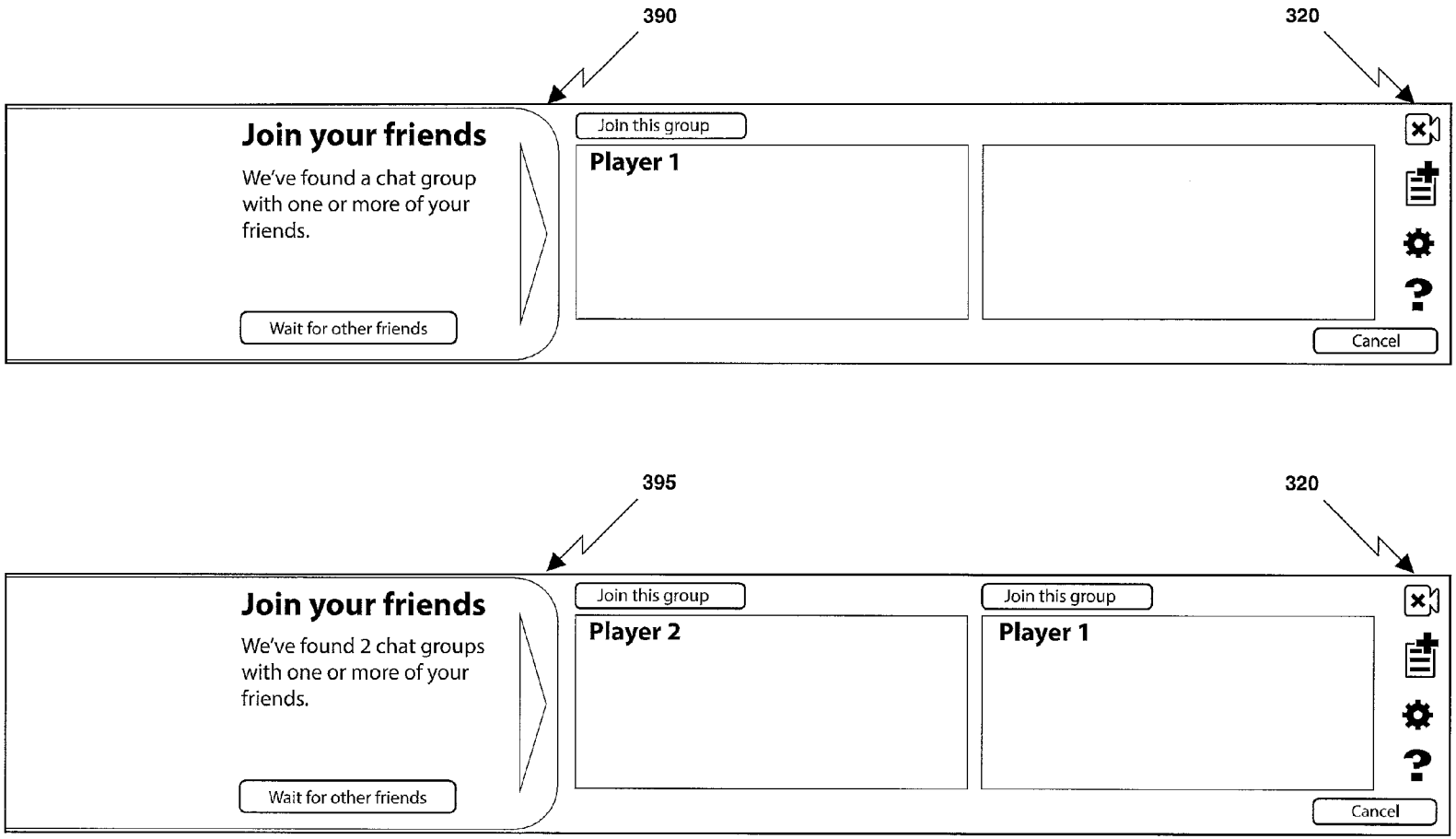

With regard to finishing this example of a particular network being established and then starting communications among the players, the first player can re-insert her id card 120-1 into the first card reader 110-1, according to block 260 of FIG. 2, and the control 180-1 recognizes this first player's card 120-1. It should also be understood that the first player could insert her card 120-1 into a card reader 120 of another machine 100, instead of using the machine 100-1 card reader 120-1. In the case in which the first id card 120-1 is the first or only id card of this particular group of players inserted into a card reader 110, this recognition causes the "waiting for friends" screen 380 of FIG. 3D to be displayed on the video screen 150-1 of the first gaming machine 100-1. The screen 380 is indicative of the fact that a group of players, including the first player, has created a list of players for communication with each other and the first player is waiting until at least one other player in the list has her or his id card inserted into another card reader 110. Referring to FIG. 2B and block 270 and continuing with this representative example of operation, the second player inserts her id card 120-2 into the second card carder 110-2 of the second gaming machine 100-2. Upon obtaining the identity-related information from this card 120-2 using the control 180-2, a "join your friends" screen 390 of FIG. 3E is displayed using the video screen 150-2 of the second gaming machine 100-2, which includes the name(s) or identity(ies) of any other player(s) involved with the network being formed and whose id card 120 is inserted in a card reader 110 of a different gaming machine 100. In this example, only the first player's name is listed since the id card of the first player is the only other card 120 of this group that is presently in a card reader 110. By contacting or otherwise selecting the "join this group" button, selector or element, the second player and first player are linked to be able to communicate with each other. Likewise, as each of the other players in the formed network insert their id cards 120 into the card readers 110 of their respective gaming machines 100 that they are to be using, including the nth player inserting the nth card 120-*n* into the nth card reader 110-*n* of the nth gaming machine 100-*n*, as stated in block 280, a "join your friends" screen 390 is displayed that includes the names of those players whose cards 120 are in their respective card readers 110. And, each of these players can be linked for communications by enabling the "join this group" button. As a consequence, this particular or first communications network is established involving the first through nth players using the first through nth machines 100, as outlined in block 290, whereby these players can verbally and visually communicate with each other using their respective machines.

With respect to the actual verbal communications among such players using the microphones 130 and the speakers 160 and the actual visual communications using the cameras 140 and the video screens 150 of the machines 100 being used by the players, reference is made to the afore-said incorporated patent applications and particularly the descriptions therein related to the controlling and otherwise providing of such communications using the selectors or other elements displayed on each video screen. Generally, each player is able to control each of the verbal and video outputs it wants to provide to each of the other players involved in the formed network, as well as the verbal and video inputs received by each player. By way of example only, the first player can select to have the audio she receives using the audio speaker(s) 160-1 be limited to less than all the players on the network. In a further example, the first player can select to have the video input received by her camera 140-1 not be sent to any of the other players or, alternatively, to a selected one or more of the other players. In a preferred embodiment, an image related to each player in the network with an inserted id card 120 is provided to each of the machines 100 according to a predetermined arrangement and using an image determined by each player, who controls sending the image. Referring to the first player and the video screen 150-1 that she is using, her own selected image is positioned relatively to the right on the screen 150-1, with the other players selected images being located to the left of the first player's image. Likewise, the second player's selected image is relatively positioned to the right on the screen 150-2, with the other players selected images being located to the left of the second player's image. This same kind of arrangement is provided for each of the other players using this network. With regard to the order of the other players' images, which are to the left on the screens 150, they are located in positions that can depend on when their id cards 120 were inserted relative to other players involved in the network.

As an alternative to the communications network being established as a peer-to-peer network as described in the incorporated applications, the communications network being formed using the gaming machines 100 could involve the use of central controller or server arranged in a "star" configuration with the gaming machines 100. Generally, each of the gaming machines 100 would connect directly with this main or central controller and all communications involving two or more machines 100 pass through the central controller before being sent to the destination gaming machine or machines 100 for output using the video screens 150 and/or the speaker(s) 160 thereof.

Figure 4:
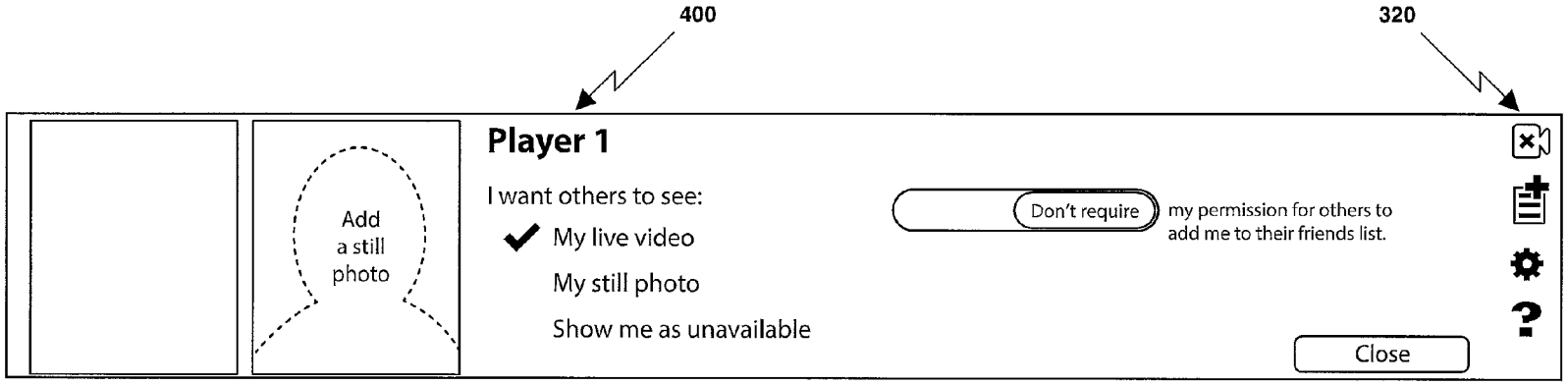
FIG. 4 illustrates a "settings" screen display including elements controllable by the player.

Each player's own image that can be provided is selected or controlled by that player. Such control is achieved using the "my settings" icon (with accompanying word label depicted in the "welcome" screen 310). Upon the player contacting or otherwise enabling this icon from the "welcome" screen 310 or any other screen that has this icon, a "settings" screen 400 is displayed on that player's video screen 150. One embodiment of a "settings" screen is shown in FIG. 4. This screen includes three options from which a player can make a choice related to her selected image that can be sent to other players. These options include: a live video, a still photo, or player unavailable indicia (essentially the player choosing not to provide any image or other video). As can be understood, the player (e.g. the first player) has the ability to change to a different option at any time using the "settings" screen 400.

This screen 400 also has a "permission request" selector. This controllable and changeable selector enables a requestee, not requestor, user or player to determine whether the requestee player will be automatically added to a friends' list of another player. The requestor player is the player who wants to add the requestee player to the requestor player's "my friends" list. Related to that, the requestee player controls through her associated "permission request" selector whether the requestee player is added to that list. When the "permission request" selector associated with the requestee player is in the "don't require" position or state, then that player is automatically added to the requestor player's "my friends" list. This position is shown in FIG. 4. When the "permission request" selector is in the opposite state or position ("do require"), then the player is not automatically added. As an example, when the "permission request" selector associated with a mth player is in the "do require" position and whenever identity-related information of the mth player is not input by the card reader 110-1 (e.g., input using the displayed keyboard associated with the first player), during the network forming representative example of FIGS. 2A-2B, the mth player is not added to the first player's list. Since the mth player is not included in the first player's friends' list (and the first player is not included in the mth player's friends' list), the advantages associated therewith are not available to the mth player when another or different network could later be formed that might include the mth player. For example, after the particular network described in connection with FIGS. 2A-2B is terminated, if the mth player is not on the first player's friends' list and both these players insert their cards 120-1, **120-*m* into different gaming machines 100 to seek to establish another network, no indication would be provided using a "join friends" screen 390** that the first and mth players are available for communication. Contrastingly, such indication would be provided if the mth player's "permission request" selector had been in the "don't require" position when the first player types in the mth player's identity-related information using the displayed keyboard.

Continuing with reference to block 500 of FIG. 2B, a variation related to the first communications network of FIGS. 2A-2B is described in the context of adding another slot machine 100 (mth machine) to the network, which is to be played by the mth player. This mth machine is being added after the first communications network was completed involving the first through nth players ("done" button of screen 360 of FIG. 3C was enabled after the nth player was included). The mth player can be added to the network by accessing her id card **120-*m* by means of the card reader 120-1 of the first machine 100-1 being used by the first player in this example. Alternatively, as just discussed, the mth player could be added to the first communications network by causing the keyboard to be displayed on the video screen 150-1 of the first player and inputting identity-related information of the mth player using the keyboard. After the mth player's identity-related information is input, the mth player can insert her card 120 into the mth machine card reader 110 and then be able to communicate with all other players who are involved with this particular network. In the case in which the mth player's card 120 is read by the first player's card reader 120-1, the first player and the mth player would be included in each other's friends' list. However, the mth player would not be added to any other friends' list (second through nth player's lists). In the case in which the mth player's identity-related information is input by means other than the first card reader 110-1**, such as using the keyboard by, and associated with, the first player, the mth player would be added to the first player's friends' list only if the mth player's "permission request" selector was in the "don't require" position, such as previously being placed in that state by the mth player. Related to that, the first player would be automatically added to the mth player's friends' list.

As a possible alternative to the requirement that the player's permission request selector be in the "don't require" position, a "badge" or other indicator could be used that is included adjacent to the "my friends" icon. Continuing with the previous example involving the first and mth players, when the first player has finished inputting the mth player's identity-related information, a friend request is created. The next time the mth player inserts her id card, including immediately if the mth player's card is currently inserted, a badge is displayed adjacent to the mth player's "my friends" icon. If this badge were engaged or otherwise used by the mth player, for example, a notification is shown on the mth player's machine screen. The notice would query the mth player to the effect: "first player requests permission to add you to the first player's 'my friends' list." If the mth player responds to the first player's notification in the affirmative, then the first player is added to the mth player's friends' list and the mth player is added to the first player's friends' list, even if the mth player's permission request selector were in the "do require" position.

As well as a machine 100 and its associated player being later added to the first communications network established according to FIGS. 2A-2B, one or some machines 100 could be removed from the network without terminating it. Referring to block 510 of FIG. 2B and as an example, at least the second slot machine is removed from this network. This removal is accomplished by the second player removing her card 120-2 from the card reader 110-2. Removal of the id card 120-2 results in this card no longer acting as a fingerprint or signature associating the machine 100-2 with the second player, thereby allowing this machine to be used by any other player including a player who is not, and will not be, part of this first communications network. The remaining players in the network can continue to communicate with each other as before, and without any verbal and/or video communications from the second machine 100-2. Extending the example from one machine to all machines being removed from the network, the first communications network can be terminated, as noted by block 520 of FIG. 2B, when all players involved with the network are finished using their gaming machines 100 and/or no longer wish to continue communicating with each other using the network. Such termination of the communications network is accomplishable when all players, or all players except one player, remove their cards 120 from the card readers 110 of the machines being used by them.

Once such an initial communications network is formed as described in conjunction with FIGS. 2A-2B, possible subsequent networks involving two or more players of the initial network can be established with fewer steps and less time because of the stored and maintained friends' lists. If the first and second players, for example, desire to communicate while playing gaming machines 100 some time or day(s) after the initial network was formed, these two players can insert their cards 120 into card readers 110 of different machines 100. The controls 180, upon obtaining the identity-related information from these cards 120, can process such information and find that the first and second players are on each other's friends' list. Such a determination leads to the control 180 of at least one of these two machines 100 causing its video screen 150 to display a "join friends" screen 390 of FIG. 3E, which will include the identity-related information of the first and second players. Contacting or otherwise enabling the "join this group" selector on the screen 390 results in these two players establishing their own communications network. As can be appreciated, it is not necessary that two or more players, who are on each other's friends' list and who may be interested in communicating using their machines 100, be aware of each other's presence at a casino having the machines 100 prior to inserting their cards 120 into different card readers 110. They can become aware of each other's presence using their inserted cards 120 and the information provided by the "join friends" screen 390.

Another variant associated with the "join friends" screen 390 relates to a further utility being available, namely, a player being able to join a selectable one of more than one group of friends as part of forming a communications network. As discussed related to the formation of the initial network of FIGS. 2A-2B, one or a first group of players or friends was created and all these players were involved in this first communications network. More than one selectable group for communications could, for example, be made available when a number of those same players, including the first and second players, involved in the first communications network want to play the gaming machines 100 at another time (some time after the first communications network was terminated). According to the example, the first player could insert her id card 120-1 into a machine's card reader 110 and, assuming the first player is at that time the only player from that first communications network group that has an inserted card 120, the "waiting for friends" screen 380 would be displayed. Next, assuming that the second player inserts her card 120-2 into another machine's card reader 110, a "join friends" screen 390 would be displayed by the second player's machine 100. This screen 390 would indicate that the first player is in a group by herself and could be joined by the second player. If, however, the second player contacts or otherwise selects "wait for other friends" on the screen 390, a "waiting for friends" screen 380 is displayed. Next, if another player (e.g. third player), who was also part of the first communications group, inserts her card 120, the "join friends" screen 395 of FIG. 3E displays two groups from which one could be selected. That is, the third player could decide to join the first player's group or the second player's group and, if one of those two groups were selected, then the third player and the player whose group was selected would form a particular communications network. Alternatively, if it were assumed that the third player, like the second player, enabled the "wait for other friends" button found with screen 390, then the third player would be part of another or third group that would be displayed, if still another player (e.g. fourth player) inserted her card 120 into a machine's card reader 110. Consequently, various group options for communications and new network formations can be achieved, depending on player desires and friends' lists that have been previously devised.

The foregoing discussion has been presented to illustrate and encompass various embodiments of the invention, including all types of gaming machines such as different types of slot machines (e.g. reel symbol slot machines, having one or both of mechanical and electrical components), as well as video poker machines, video blackjack machines, bingo machines, keno machines and lottery machines. Related to that, a particular communications network might involve a mix of different types of gaming machines, such as one or more slot machines, one or more video poker machines and one or more video blackjack machines. Further, the description is not intended to limit the invention to the form disclosed herein. Consequently, further variations and modifications commensurate with the above teachings, within the skill and knowledge of the relevant art, are within the scope of the present invention. The embodiments described hereinabove are further intended to explain the best modes presently known of practicing the invention and to enable others skilled in the art to utilize the same as such, or in other embodiments, and with the various modifications required by their particular application or uses of the invention. It is also intended that the claims be construed to include alternative embodiments to the extent permitted by the prior art.

What is claimed is:

1. A system for use in communicating using a first communications network, involving gaming machines, comprising: a plurality of gaming machines including at least first and second gaming machines, each of said plurality of gaming machines including: a card reader, a camera, a video screen, a microphone, at least one audio speaker and a control; and a plurality of cards including first and second cards for storing identity-related information, said first card being associated with a first player and said second card being associated with a second player and in which said first card has identity-related information associated with the first player and does not have identity related information associated with the second player, and in which said second card has identity-related information associated with the second player and does not have identity related information associated with the first player; wherein said card reader of said first gaming machine and said control of said first gaming machine are used to obtain said identity-related information associated with the first player when said first card is positioned in said card reader of said first gaming machine, with an initial first player display being initially displayed using said video screen of said first gaming machine when said card reader and said control of said first gaming machine are used to obtain said identity-related information associated with the first player and in which said first gaming machine is unable to be used to communicate while said first card is positioned therein, wherein said control of said first gaming machine is used in obtaining said identity-related information associated with the second player after said identity-related information associated with the first player is obtained, after said initial first player display, and after removal of said first card from said card reader of said first gaming machine, with an initial second player display being initially displayed using said video screen of said first gaming machine when said control of said first gaming machine is used in obtaining said identity-related information associated with the second player, said initial second player display being different than said initial first player display, and wherein a first communications network list is generated and stored when said control of said first gaming machine is used in obtaining said identity-related information associated with the second player in response to said initial second player display, with said first communications network list being related to the second player being part of said first communications network with the first player; and wherein, after said initial first player display is displayed, an initial second player join display is initially displayed using a video screen of said second gaming machine when said second card is held in said card reader of said second gaming machine, said initial second player join display being different than each of said initial first player display and said initial second player display and in which at least portions of said stored first communications network list is displayed, using at least one of: (i) said video screen of said first gaming machine in response to said first card being re-inserted in said card reader of said first gaming machine and (ii) said video screen of said second gaming machine in response to said second card being inserted in said card reader of said second gaming, for use in initially establishing said first communications network.

2. A system of claim 1 wherein said card reader of said first gaming machine obtains said identity-related information associated with the second player using said second card and in which said first gaming machine is unable to be used to initiate a communication while said second card is inserted in said card reader of said first gaming machine.

3. A system of claim 2 wherein said second card is held in said card reader of said second gaming machine and said first card is re-positioned in said card reader of said first gaming machine.

4. A system of claim 1 wherein said first gaming machine allows said identity-related information to be typed in.

5. A system of claim 1 wherein said video screen of said first gaming machine displays at some time information related to each of the following: an add selector for use in enabling an including of the second player to said first communications network list; and at least portions of said first communications network list that is stored.

6. A system of claim 1 for use in communicating using one of: (i) a central controller in communication with said first and second gaming machines; and (ii) independently of any central controller.

7. A system of claim 1 wherein, after said initial second player display, said video screen of said first gaming machine displays a subsequent display related to including identity-related information associated with another player, said first communications network list being updated to include the another player.

8. At least one non-transitory computer readable medium storing a client computer program operable in association with at least a first gaming machine of a plurality of gaming machines in connection with initially establishing a first communications network, the client computer program for execution using a control of said first gaming machine, the client computer program comprising sets of instructions for:

obtaining identity-related information associated with a first player when a first card is positioned in a card reader of said first gaming machine, with an initial first card display being initially displayed using a video screen of said first gaming machine when said first card is positioned therein and in which said first gaming machine is unable to be used to communicate while said first card is positioned therein;

obtaining identity-related information associated with a second player when a second card is positioned in said card reader of said first gaming machine after removal of said first card, with an initial second card display being initially displayed using said video screen of said first gaming machine when said second card is positioned therein and after said initial first card display is displayed, said initial second card display being different than said initial first card display and in which said first gaming machine is unable to be used to communicate while said second card is positioned therein, wherein a first communications network list is generated and stored when said second card is positioned in said card reader of said first gaming machine in response to said initial second card display;

initially establishing a first communications network involving at least two of said plurality of gaming machines, with the first player using one gaming machine of said at least two of said plurality of gaming machines and the second player using an other one gaming machine of said at least two of said plurality of gaming machines, wherein, after said initial second card display is displayed, an initial second card join display is initially displayed using a video screen of said other one gaming machine when said second card is positioned in a card reader of said other one gaming machine, said second card join display being different than each of said initial first card display and said initial second card display, and in which at least portions of said stored first communications network list is displayed, using at least one of: (i) a video screen of said one gaming machine in response to said first card being inserted in a card reader of said one gaming machine and (ii) said video screen of said other one gaming machine in response to said second card being inserted in a card reader of said other one gaming machine; and enabling voice and video communications using said first communications network;

wherein said identity-related information associated with the second player is not obtained from said first card and said identity-related information associated with the first player is not obtained from said second card.

9. The at least one non-transitory computer readable medium of claim 8 wherein the computer program further comprises a set of instructions for use in displaying a subsequent display, after said initial second card display, using said video screen of said first gaming machine, said subsequent display related to being able to include identity-related information associated with another player and with said first communications network list being updated to include the another player when a card of the another player is positioned in said card reader of said first gaming machine.

10. The at least one non-transitory computer readable medium of claim 8 wherein the computer program further comprises a set of instructions, in connection with said enabling voice and video communications, used by said first gaming machine when said at least two of said plurality of gaming machines includes said first gaming machine.

11. The at least one non-transitory computer readable medium of claim 8 wherein the computer program further comprises a set of instructions for displaying at some time information related to each of the following:

an add selector for use in enabling an adding of the second player to said first communications network list; and at least portions of said first communications network list that is stored using said video screen of said first gaming machine.

12. The at least one non-transitory computer readable medium of claim 8 wherein the computer program further comprises a set of instructions that enables inputting of said identity-related information associated with the second player without using said card reader of said first gaming machine.

13. A system of claim 2 that allows the first player to position said first card in said card reader of said first gaming machine, that allows the first player to remove said first card from said card reader of said first gaming machine, and that allows the second player to position said second card in said card reader of said first gaming machine.

14. A system for use in communicating using a first communications network involving gaming machines, comprising:

a plurality of gaming machines including at least first and second gaming machines, each of said plurality of gaming machines including: a card reader, a video screen and a control and with said first gaming machine including a first card reader and said second gaming machine including a second card reader; and a plurality of cards including first and second cards for storing identity-related information, said first card having identity-related information associated with the first player and not having identity related information associated with the second player, said second card having identity-related information associated with the second player and not having identity related information associated with the first player;

wherein said first card and said first card reader are used to obtain said identity-related information associated with the first player when said first card is positioned in said first card reader, with an initial first player display being initially displayed using said video screen of said first gaming machine when said first card is positioned in said first card reader and in which said first gaming machine is unable to be used to communicate while said first card is positioned therein, wherein said first gaming machine is used in obtaining said identity-related information associated with the second player after said identity-related information of the first player is obtained, after said initial first player display, and after removal of said first card from said first card reader, with an initial second player display being initially displayed using said video screen of said first gaming machine when said first gaming machine is used in obtaining said identity-related information associated with the second player, said initial second player display being different than said initial first player display, and wherein a first communications network list is generated and stored when said first gaming machine is used in obtaining said identity-related information associated with the second player in response to said initial second player display, with said first communications network list being related to the second player being part of said first communications network with the first player; and wherein, after said initial first player display is displayed, an initial second player join display is initially displayed using a video screen of said second gaming machine when said second card is held in said second card reader, said initial second player join display being different than each of said initial first player display and said initial second player display, and in which at least portions of said stored first communications network list is displayed, using at least one of: (i) said video screen of said first gaming machine in response to said first card being re-inserted in said first card reader and (ii) said video screen of said second gaming machine in response to said second card being inserted in said second card reader, for use in initially establishing said first communications network.

15. A system of claim 14 wherein said second card associated with the second player is positioned in said first card reader and in which said first gaming machine is unable to be used to initiate a communication while said second card is positioned in said first card reader.

16. A system of claim 14 wherein said identity-related information is typed in using said first gaming machine.

17. A system of claim 14 wherein a subsequent display, after said initial second player display, is displayed using said video screen of said first gaming machine, said subsequent display being used to include identity-related information associated with another player, with said first communications network list being updated related to the another player being part of said first communications network with the first player and the second player.

18. A system of claim 14 wherein said initial second player display includes a friends icon related to including the second player in said first communications network list.

19. A system of claim 14 wherein said video screen of said first gaming machine displays settings that include: image-related information associated with the first player and an indicator related to permission by the first player to be included with another communications list related to communications involving at least a third player different than the second player.

20. A system of claim 14 wherein said initial second player join display is related to said first communications network list.

* * * * *